US008540009B2

(12) United States Patent
Walker et al.

(10) Patent No.: US 8,540,009 B2
(45) Date of Patent: Sep. 24, 2013

(54) HOLLOW SAND CORES TO REDUCE GAS DEFECTS IN CASTINGS

(75) Inventors: Michael J. Walker, Windsor (CA); Thomas C. Pederson, Rochester Hills, MN (US); Jason R. Traub, Chesterfield, MI (US); Anil K. Sachdev, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 333 days.

(21) Appl. No.: 12/390,798

(22) Filed: Feb. 23, 2009

(65) Prior Publication Data

US 2010/0212854 A1 Aug. 26, 2010

(51) Int. Cl.

| | |
|---|---|
| ***B22C 9/02*** | (2006.01) |
| ***B22C 9/10*** | (2006.01) |
| ***B22C 9/12*** | (2006.01) |

(52) U.S. Cl.

USPC ..... 164/16; 164/21; 164/369

(58) Field of Classification Search

USPC ..... 164/16, 369, 20, 21, 131

See application file for complete search history.

(56) References Cited

U.S. PATENT DOCUMENTS 3,584,680 A 6/1971 Le Blanc et al.

FOREIGN PATENT DOCUMENTS

| | | | |
|---|---|---|---|
| JP | 2-160141 A | * | 6/1990 |
| JP | 2002-120045 A | * | 4/2002 |
| JP | 02002120045 A | | 4/2002 |

* cited by examiner

*Primary Examiner* — Kevin P Kerns

(74) *Attorney, Agent, or Firm* — BrooksGroup

(57) ABSTRACT

An exemplary method for forming a sand core includes forming a core insert; forming a sand core precursor around the core insert; and creating at least one passage within the sand core precursor by removing or otherwise transforming a portion of the core insert, wherein the at least one passage includes at least one exit point. The sand core may then be utilized in a casting mold assembly to form a cast part.

19 Claims, 4 Drawing Sheets

HOLLOW SAND CORES TO REDUCE GAS DEFECTS IN CASTINGS

TECHNICAL FIELD

The technical field generally relates to mold casting techniques and, in particular, to the introduction of hollow sand cores to reduce gas defects in castings.

BACKGROUND

Casting is a manufacturing process by which a liquid material is (usually) poured into a mold, which contains a hollow cavity of the desired shape, and then allowed to solidify. The solid casting is then ejected or broken out to complete the process.

Sand casting is one type of casting process in which a cast part is produced by forming a mold from an assembly of sand cores and pouring molten liquid metal into the cavity of the mold. The mold and metal are then cooled until the metal has solidified. In the last stage the casting is separated from the mold.

Cold box and no bake technologies are types of sand casting processes that use organic and/or inorganic binders that strengthen the sand core by chemically adhering to the sand. In cold box and no bake technologies, the resin is cured using a catalyst reaction to harden the entire core inside and out prior to the introduction of liquid material that is cast to a desired shape. Green sand technology uses clay to bind the sand and is used for making molds where sand cores, if required, are placed into.

SUMMARY OF EXEMPLARY EMBODIMENTS OF THE INVENTION

One exemplary method includes forming a core insert, forming a sand core around the core insert, and creating at least one passage within the sand core by removing or otherwise transforming a portion of the core insert, wherein at least one passage includes an exit point.

Another exemplary method includes forming a core insert, forming a sand core around the core insert, creating at least one passage within the sand core by removing or otherwise transforming a portion of the core insert, wherein at least one passage includes an exit point, introducing the sand core as part of a casting mold assembly having a vent, wherein the vent is coupled to the exit point, and casting a part within the casting mold assembly, wherein the gas generated during the casting process escapes the sand core through the passages to the exit point and the vent.

Other exemplary embodiments of the invention will become apparent from the detailed description provided hereinafter. It should be understood that the detailed description and specific examples, while disclosing exemplary embodiments of the invention, are intended for purposes of illustration only and are not intended to limit the scope of the invention.

BRIEF DESCRIPTION OF THE DRAWINGS

Exemplary embodiments of the invention will become more fully understood from the detailed description and the accompanying drawings, wherein.

DETAILED DESCRIPTION OF EXEMPLARY EMBODIMENTS

The following description of the embodiment(s) is merely exemplary (illustrative) in nature and is in no way intended to limit the invention, its application, or uses.

Figure 1:
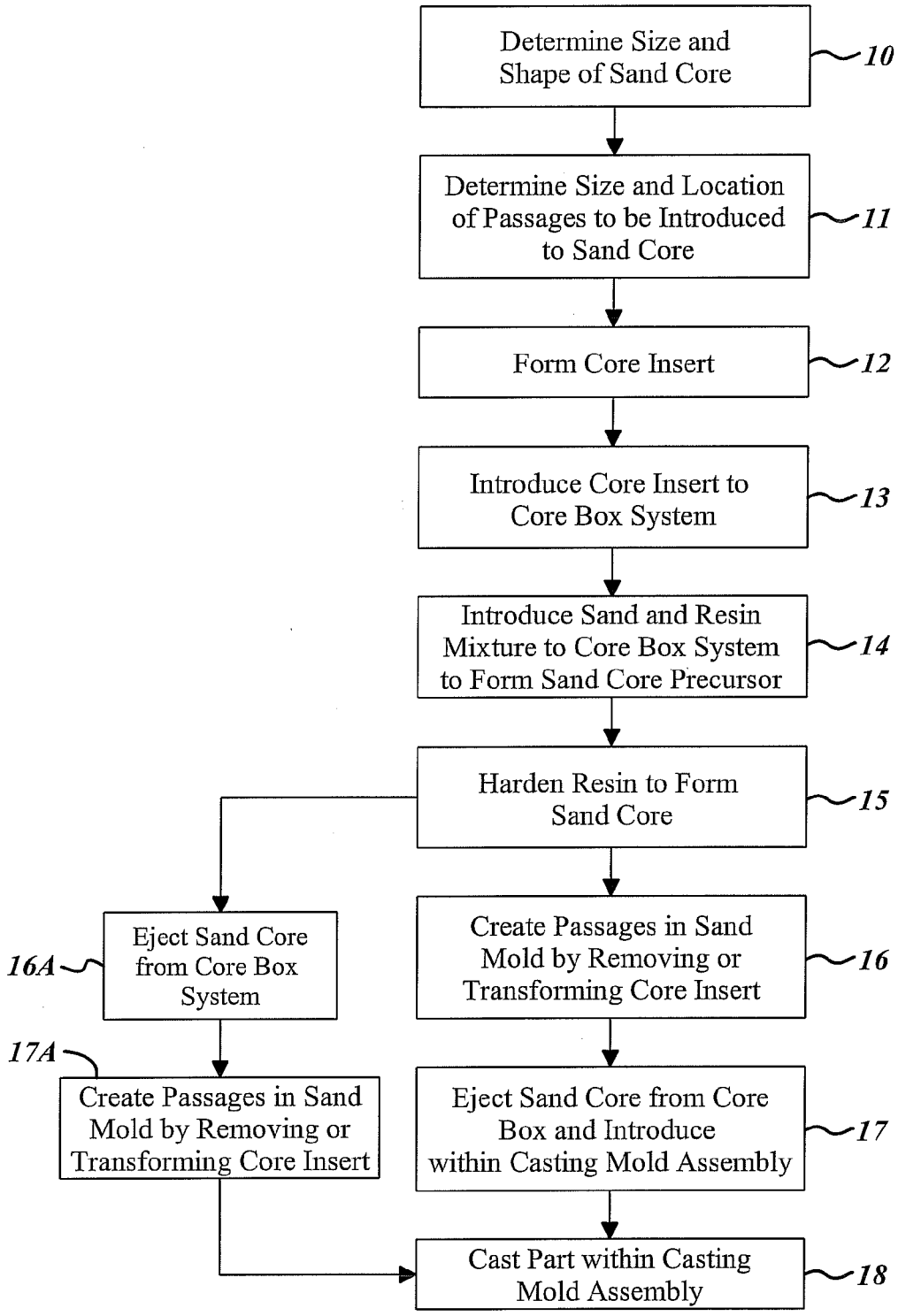
FIG. 1 is a logic flow diagram for forming a sand core within a core box system, and subsequently using the formed sand core to form a cast part, in accordance with an exemplary method.

Referring first to FIG. 1, an exemplary method for forming a sand core within a core box system, and the subsequent production of a cast part utilizing the sand mold, is illustrated in a logic flow diagram. Supplementary FIGS. 2-6 aid in explaining the formation of the cast part at various stages from a sand core and sand core precursor formed in accordance with one exemplary embodiment.

Referring first to FIG. 1, the method begins, as shown in box 10, by determining a size and shape of a sand core (shown as 69 in FIGS. 4A, 4B, and 5) that may be subsequently used to form a cast part in a sand mold.

Next, in box 11, a determination may be made for the size and location of one or more internal passages (shown as 56 in FIGS. 4A and 4B), including one or more exit points (shown as 58 in FIG. 4A), to be introduced within the sand core 69 to provide a passageway for the escape of gases during the subsequent casting process.

Next, in box 12, one or more core inserts 20 may be formed roughly corresponding in approximate size and shape to each of the internal passages 56 as determined in box 11.

Figure 2:
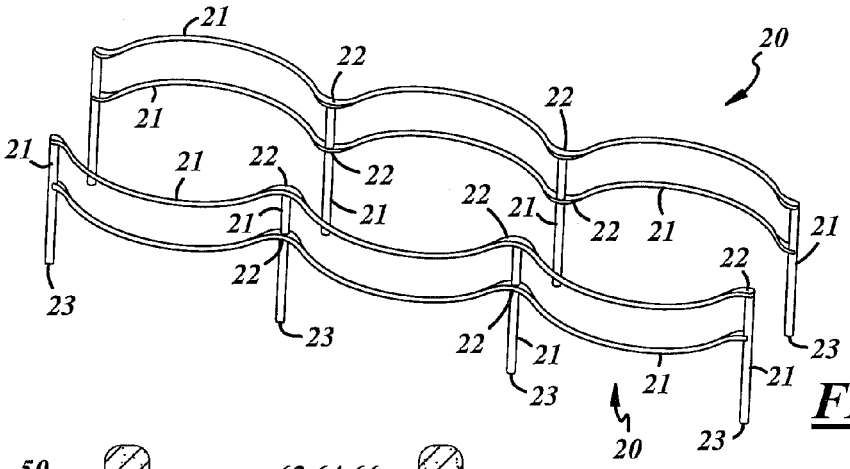
FIG. 2 is a schematic illustration of a pair of sand core inserts according to one exemplary embodiment.

Referring now to FIG. 2, one exemplary embodiment of a pair of formed core inserts 20 may be illustrated for use in one exemplary sand core. The core inserts 20 may include any variety of spokes 21 that may be interconnected at coupling points 22. The spokes 21 may be of any defined dimension and shape and may include at least one end 23 that will define an exit point 58 for gases in the subsequently formed sand core 69.

The core inserts 20 may be formed from a wide variety of materials utilizing a wide variety of different formation methods. The materials may be at least partially thermally or chemically degradable to create the passages 56 within the sand core 69. In addition, the materials of the core inserts 20 may have a different reactivity than the resin component 66 to allow then to remain in their original state (i.e. not chemically or thermally degrade) when the resin component 66 may be hardened or cured as described above in box 15.

In one exemplary embodiment, the core insert 20 may be formed from a foam material having a low collapse temperature. A collapse temperature, by definition for the purposes herein, is a temperature in which a material at least partially degrades, shrinks, or is otherwise acted upon to create a passage (shown as 56 in FIG. 4A) within the hardened sand core 69. The collapse temperature may be greater than any temperature increase associated with hardening or curing the resin component 66 to form the hardened sand mold 69 as described below in box 17.

Non-limiting exemplary foam materials that may form the core insert include Styrofoam™, methyl methacrylate foam, polystyrene foam, and polyalkylene carbonate foam. In addition, these foam materials may be reinforced with fibers such as carbon fibers, aramid fibers, glass fibers or other polymeric and non-polymeric fibrous materials to provide some degree of structural reinforcement.

In another exemplary embodiment, the solid core insert 20 may be formed from a meltable or sublimable material that melts, or sublimes, to form the passage 56. As with the foam materials, the meltable or sublimable temperature of these materials may be greater than any temperature increase associated with hardening or curing the resin component 66 to form the sand core 50 as described below in box 15.

Exemplary meltable materials may be utilized include wax, polymers having a melting point below about 200 degrees Celsius, inorganic materials such as salts, or ultra low melting alloy materials such as solders. In addition, these meltable materials may be reinforced with fibers such as carbon fibers, aramid fibers, glass fibers or other polymeric and non-polymeric fibrous materials to provide some degree of structural reinforcement. Moreover, other meltable composite materials, or meltable organic or inorganic materials including filler materials, may also be utilized.

Sublimable materials may include any material that sublimates below about 200 degrees Celsius. Exemplary sublimable materials include organic polymers such as camphor.

Of course, other polymeric and non-polymeric materials may also be contemplated herein to form the core insert 20, provided that they can be removed or otherwise acted upon to create the passages 56 without adversely affecting the surrounding sand core 69. Moreover, similar to the foam materials, meltable materials, and sublimable materials described above, these other materials may not degrade or otherwise be transformed to create the passages 56 at or below the temperature associated with hardening or curing the resin component 66 to form the hardened sand core 69 as described below in box 17.

Referring back to FIG. 1, in box 13, the one or more core inserts 20 may be introduced into the interior 54 of a core box system 52 at predetermined locations.

Figure 3B:
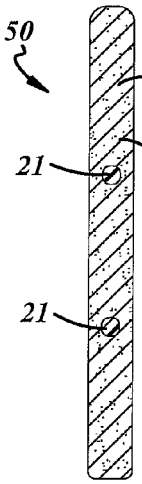
FIG. 3B is a section view of the sand core of FIG. 3A taken along line 3B-3B.
Figure 3A:
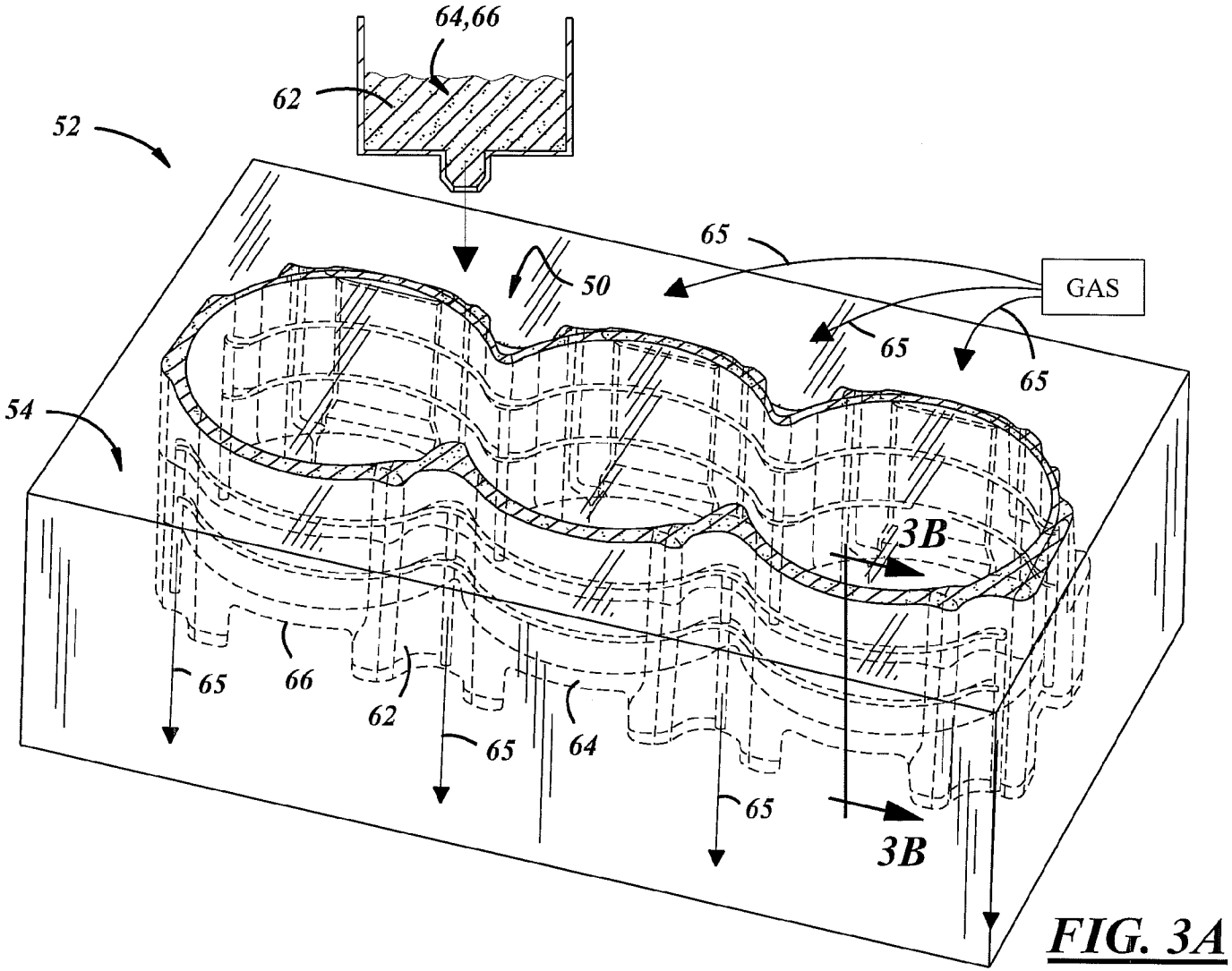
FIG. 3A is a schematic illustration of a sand core precursor formed within a core box system according to one exemplary embodiment and including the sand core inserts of FIG. 2.

In box 14 of FIG. 1 and as shown in FIGS. 3A and 3B, a mixture 62 of sand 64 and resin 66 may be blown into the interior 54 of the core box system 52 to fill the interior region 54 around the one or more core inserts 20 to form a sand mold precursor 50 in such a way so that the ends 23 of the spokes 21 of the core inserts 20 are not covered (i.e. they are exposed) with sand 64 and resin 66.

Figure 4B:
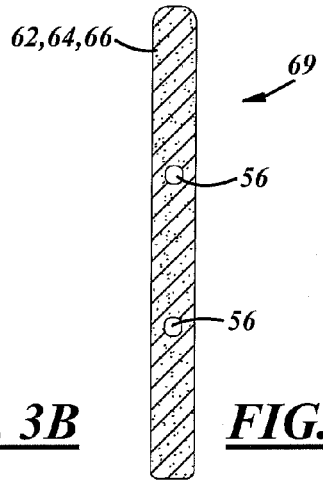
FIG. 4B is a sectional view taken along lines 4B-4B of FIG. 4A.
Figure 4A:
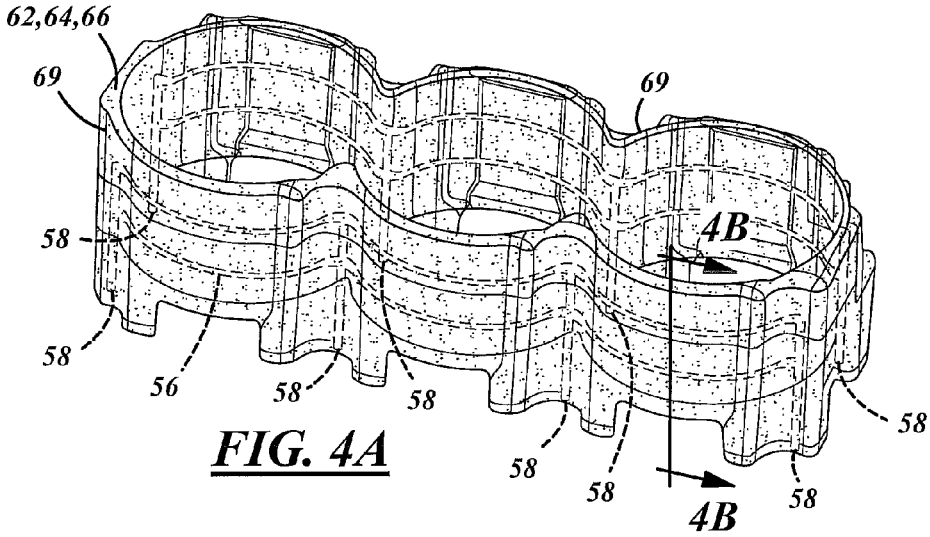
FIG. 4A is a schematic illustration of a sand core formed from the sand core precursor of FIG. 3A after ejection from the sand core box.

In box 15, the resin component 66 of the mixture 62 may be hardened around the one or more core inserts 20, therein forming the sand core 69 as shown in FIGS. 4A and 4B from the sand mold precursor 50. This hardening step may be performed in such a way as to not adversely affect the one or more core inserts 20. In many exemplary embodiments, the hardening step coincides with the curing of the resin component 66.

In one exemplary embodiment, also shown in FIG. 3A, triethylamine gas 65 may be introduced within the interior 54 of the core box system 52. The gas 65 may be blown through the sand mold precursor 50 to cure the resin component 66 to form the sand core 69, wherein the resin component 66 is a polyurethane material. The curing of the polyurethane material 66 may cause the resin component 66 to harden and, in essence, fuse or otherwise couple together the sand component 62 and resin component 66 in an integral structure.

In other exemplary embodiments (not shown), other types of curing mechanisms such as heat or radiation may be used to harden the resin component 66 without adversely affecting the one or more core inserts 20.

In still other exemplary embodiments (not shown), the hardening may be accomplished without an associated curing step (i.e. the resin hardens without curing). For example, a catalyst (not shown) may be mixed with the resin component 66 that causes the resin component 66 to cure within a specific period of time to fuse together the sand component 62 and resin component 66 without adversely affecting the sand core inserts 20.

Next, in box 16, the one or more core inserts 20, or at least a portion of the one or more core inserts 20, are removed or otherwise transformed to create a corresponding located internal passage 56 within the hardened sand core 69. The end portion 23 of the one or more core inserts 20 may be removed or transformed to create the corresponding exit point 58.

The precise method for removal or transformation of the one or more inserts 20 to create the passages 56 and exit points 58 may be determined by the composition of the one or more core inserts 20 as described above.

For example, core inserts 20 formed from collapsible materials, such as the foam materials described above, may be transformed to create the passages 56 by heating the sand core 69 to an elevated temperature (i.e. above the collapse temperature for the material) sufficient to cause the core inserts 20 to collapse (i.e. breaks down or otherwise be altered) to create voids representing the passages 56.

Core inserts 20 formed from meltable materials, by contrast, may be melted by raising the temperature of the sand core 69. The melted material may primarily then travel through the passages 56 created towards the exit points 58, either by gravity or through vacuum assist. The melted core materials may then be collected as it exits through the exit points 58 by a collection device (not shown).

Sublimable materials may be sublimed by raising the temperature above the subliming temperature of the material, therein transforming the solid core material to a gas. The gas (not shown) may travel primarily through the passages 56 created towards the exit points 58 and exit the sand core 69. The gas may be collected as it exits through the exit points 58 by a collection device (not shown) or simply allowed to enter the atmosphere.

Referring back to FIG. 1, in box 17, the sand core 69 having the internal passages 56 may be ejected from the core box system 52. The resultant sand core 69 having the passages 56 and exit points 58 may be illustrated in one embodiment in FIGS. 4A and 4B.

In an alternative arrangement to boxes 16 and 17, as shown in boxes 16A and 17A, the sand core 69, including the core inserts 20, may first, as shown in box 16A, be ejected from interior 54 of the core box system 52 prior to the removal or transformation of the core inserts 20.

Next, as shown in box 17A, the core inserts 20 may be removed in the manner described above in step 16 to create the internal passages 56 and exit points 58.

Next, in box 18, the sand core 69 may be used to form a cast part.

Figure 5:
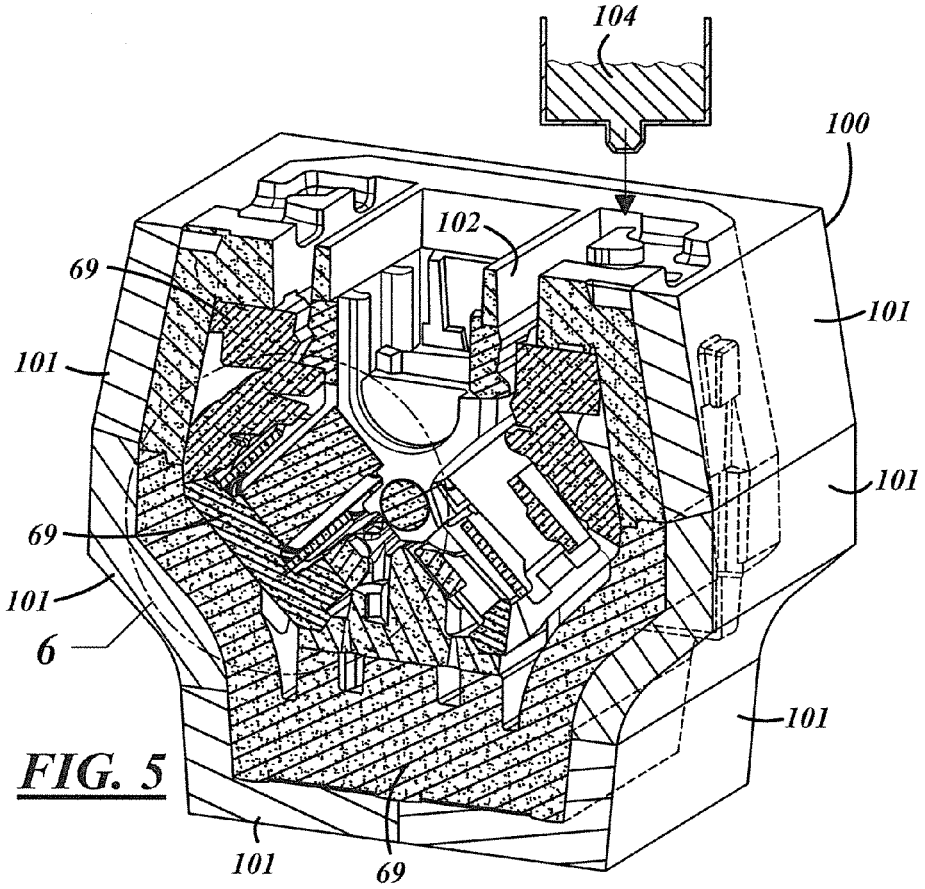
FIG. 5 is a schematic illustration of a casting mold assembly including multiple sand cores according to one exemplary embodiment.
Figure 6:
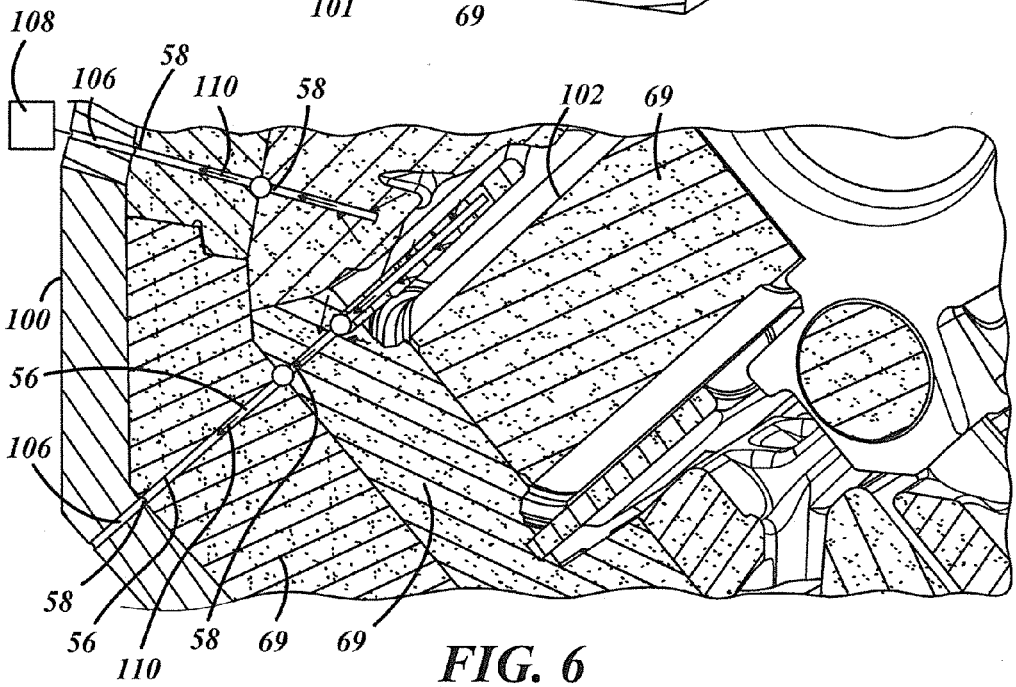
FIG. 6 is a close-up view of a portion of FIG. 5 within circle 7.

In one exemplary embodiment, a single sand core 69, or multiple sand cores 69 formed as described above, may be introduced with an interior region 102 of a casting mold assembly 100 including a vent 106. FIGS. 5 and 6 illustrate such an exemplary embodiment wherein multiple sand cores 69 are introduced within the casting mold assembly 100.

The casting mold assembly 100 may be formed from one or more pieces, here shown as multiple pieces 101, of a sand core material. The composition, and method of manufacturing of the one or more pieces 101, may be substantially similar to the sand core 69, but without passages 58 formed by the removal of core inserts 20. The casting mold assembly 100 may be formed of additional or other materials as well, such as core pieces formed by green sand technology or the like, and are thus not limited to any particular arrangement and material composition of the pieces 101 as shown in FIGS. 5 and 6. The casting mold assembly 100 may also include an outer jacket (not shown) formed of metal, a polymer, or the like that contains the sand core pieces 101 and one or more sand cores 69.

Next, a liquid material 104 may be introduced within a casting mold assembly 100 to fill the interior region 102 not otherwise occupied by the sand core 69 and sand core pieces 101. The liquid material 104 therein solidifies within the interior region 102 of the casting mold assembly 100 around the sand core 69 and pieces 101 to form a cast part (not shown). As the liquid material 104 is introduced, gas 110 may be generated due to the decomposition of the resin component 66 of the sand core 69 and pieces 101. This gas 110 follows the path of least resistance, mainly through the internal passages 56 in the sand core 69, and exits the sand core 69 through the one or more exit points 58, which may be strategically coupled with a corresponding vent 106 within the remainder of the casting mold assembly 100. A vacuum 108 may also be coupled to the vents 106 to hasten the removal of the generated gas 110. Thus, the liquid material 104 may solidify without the substantial introduction of gas 110 there through, which may result in less defects, on a macroscopic and microscopic level, in the cast part associated with the gas evolution. In this way, a complex cast part may be produced in a single casting operation with fewer gas related defects.

In alternative arrangements (not shown), the sand core or cores 69 form the entirety of the casting mold assembly 100. In other words, additional pieces 101 of sand core coupled together, or other materials noted above, that surround the sand core 69 may not be utilized.

The above description of embodiments of the invention is merely exemplary in nature and, thus, variations thereof are not to be regarded as a departure from the spirit and scope of the invention.

What is claimed is:

1. A method comprising:

forming a core insert with a plurality of spokes, wherein at least one of the plurality of spokes includes an end portion;

forming a sand core precursor around the core insert;

hardening the sand core precursor to form a sand core having an integral structure around the core insert;

creating at least one passage within the hardened sand core by removing or otherwise transforming a portion of the core insert including transforming a portion of the plurality of spokes, wherein the at least one passage includes at least one exit point.

2. The method of claim 1, wherein said core insert is formed from a material capable of collapsing at an elevated temperature to form said at least one passage.

3. The method of claim 2, wherein the material capable of collapsing comprises methyl methacrylate foam, polystyrene foam or polyalkylene carbonate foam.

4. The method of claim 1, wherein said core insert is formed from a material capable of melting at an elevated temperature to form said at least one passage.

5. The method of claim 4, wherein the material capable of melting comprises wax, a polymer having a melting point below 200° C., a salt, or a solder.

6. The method of claim 1, wherein said core insert is formed from a material capable of subliming at an elevated temperature to form said at least one passage.

7. The method of claim 6, wherein the material capable of subliming comprises camphor.

8. The method of claim 1, wherein forming a sand core around the core insert comprises:

providing a core box system having an interior portion;

introducing the core insert to the interior portion;

introducing a mixture of sand and a resin component to the interior portion to form the sand core precursor; and hardening the sand core precursor without affecting the core insert.

9. The method of claim 8, wherein hardening said sand core precursor comprises introducing triethylamine gas through said sand core precursor, wherein said resin component comprises a polyurethane material.

10. The method of claim 8, wherein hardening the sand core precursor comprises curing the resin component using heat or radiation.

11. The method of claim 10 further comprising:

introducing the one or more core inserts into an interior of a core box system at predetermined locations;

introducing a mixture of sand and a resin into the interior of the core box system surrounding the one or more core inserts without covering the at least one end with the mixture; and hardening the resin to for a sand core around the one or more core inserts without affecting the one or more core inserts.

12. The method of claim 8, wherein the resin component includes a catalyst, and the catalyst causes the said core precursor to harden within predetermined period of time.

13. The method of claim 12 further comprising:

removing or otherwise transforming at least a portion of the one or more core inserts to create the one or more internal passages within the sand core in a corresponding location.

14. The method of claim 1, wherein the hardening of the sand core precursor does not affect the core insert.

15. The method of claim 1, wherein the core insert includes a structural reinforcement component.

16. The method of claim 15, wherein the structural reinforcement component comprises carbon fibers, aramid fibers, glass fibers or a polymeric material.

17. A method comprising:

introducing a mixture of sand and a resin into an interior portion of a core box system that includes a core insert with a plurality of spokes so that at least one gas release passage is formed within the mixture of sand and resin, the at least one gas release passage being defined by interior surfaces of the mixture of sand and resin and having at least one exit point from the mixture;

curing the resin to solidify the mixture of sand and resin so that gas from the resin may escape through the at least one exit point of the at least one gas release passage and so that a sand core suitable for casting metal therein is provided.

18. A method comprising:

determining a size and shape of a sand core that may be used to form a cast part in a sand mold;

determining a size, shape and location of one or more internal passages including one or more exit points to be introduced within the sand core to provide a passageway for gases to escape during a subsequent casting process; and forming a plurality of core inserts that include spokes corresponding to the size and the shape of the one or more internal passages and having at least one end.

19. A method comprising:

determining a size and shape of a sand core that may be used to form a cast part a a sand mold;

determining a size, shape and location of a plurality of internal passages including one or more exit points to be introduced within the sand core to provide a passageway for gases to escape during a subsequent casting process; and forming a plurality of core inserts that include spokes corresponding to the size and the shape of the one or more internal passages and having at least one end.

* * * * *